United States Patent [19]

Allan et al.

[11] Patent Number: 4,763,431

[45] Date of Patent: Aug. 16, 1988

[54] HANDGUN LOCKING AND UNLOCKING APPARATUS

[76] Inventors: Robert E. Allan; Robert M. Allan, both of 1731 Colgate Cir., La Jolla, Calif. 92037

[21] Appl. No.: 911,349

[22] Filed: Sep. 25, 1986

[51] Int. Cl.[4] ..... F41C 17/08

[52] U.S. Cl. ..... 42/70.11; 42/66; 42/70.08

[58] Field of Search ..... 42/66, 70.01, 70.04, 42/70.05, 70.06, 70.08, 70.11; 70/214, 220, DIG. 51; 362/110, 114

[56] References Cited

U.S. PATENT DOCUMENTS

| | | | |
|---|---|---|---|
| 1,484,671 | 2/1924 | Pomeroy | 42/70.01 |
| 1,635,984 | 7/1927 | Corriston | 224/2 |
| 1,686,482 | 10/1928 | Windle | 42/70.11 |
| 1,972,763 | 9/1934 | Dutton | 42/65 |
| 2,742,726 | 4/1956 | Feller | 42/70.11 |
| 2,803,910 | 8/1957 | Lyle | 42/70.01 |
| 2,893,152 | 7/1959 | Peluso | 42/70.11 |
| 3,392,471 | 7/1968 | Foote | 42/70.11 |
| 3,422,560 | 1/1969 | Foote et al. | 42/70.11 |
| 3,462,869 | 8/1969 | Wallace | 42/70.08 |
| 3,550,822 | 12/1970 | Lloyd | 224/2 |
| 3,553,877 | 1/1971 | Welch et al. | 42/70.11 |
| 3,616,559 | 11/1971 | Sobolewski | 42/70.01 |
| 3,616,667 | 1/1970 | McGourty | 70/214 |
| 3,624,945 | 12/1971 | Foote | 42/70.11 |
| 3,667,261 | 6/1972 | McGourty | 70/214 |
| 3,735,519 | 5/1973 | Fox | 42/70.01 |
| 3,831,065 | 8/1974 | Martin et al. | 317/134 |
| 3,866,811 | 2/1975 | Hamby | 224/2 |
| 3,939,679 | 2/1976 | Barker et al. | 42/70.01 |
| 3,956,842 | 5/1976 | Ballenger | 42/70.11 |
| 3,978,604 | 9/1976 | Smith | 42/70.01 |
| 4,003,152 | 1/1977 | Barker et al. | 42/70.01 |
| 4,014,123 | 3/1977 | Williams | 42/70.11 |
| 4,027,508 | 6/1977 | McGourty | 70/214 |
| 4,038,846 | 8/1977 | Klann | 70/220 |
| 4,084,341 | 4/1978 | Cervantes | 42/70.11 |
| 4,105,885 | 8/1978 | Orenstein | 42/70.06 |
| 4,136,476 | 1/1979 | Centille | 42/70.11 |
| 4,154,014 | 5/1979 | Smith | 42/70.06 |
| 4,162,586 | 7/1979 | Pachmayr | 42/70.06 |
| 4,198,026 | 4/1980 | Capolupo | 42/70.11 |
| 4,261,127 | 4/1981 | Karkkainen | 42/70.11 |
| 4,299,045 | 11/1981 | Cervantes | 42/70.11 |
| 4,302,898 | 12/1981 | LaRue | 42/70.11 |
| 4,342,410 | 8/1982 | Sloan | 224/243 |
| 4,457,091 | 7/1984 | Wallerstein | 42/70.11 |
| 4,467,545 | 8/1984 | Shaw, Jr. | 42/70.01 |
| 4,488,370 | 12/1984 | Lemelson | 42/70.01 |
| 4,499,681 | 2/1985 | Bako et al. | 42/70.11 |
| 4,509,281 | 4/1985 | Dreiling et al. | 42/70.11 |
| 4,563,827 | 1/1986 | Heltzel | 42/70.11 |

*Primary Examiner*—Deborah L. Kyle
*Assistant Examiner*—Michael J. Carone
*Attorney, Agent, or Firm*—William W. Haefliger

[57] ABSTRACT

Locking devices for guns operate to lock the guns against inadvertent or unauthorized firing, and at the same time enable quick and controlled unlocking of guns, to enable their use, as against home intruders.

93 Claims, 6 Drawing Sheets

FIG. 1
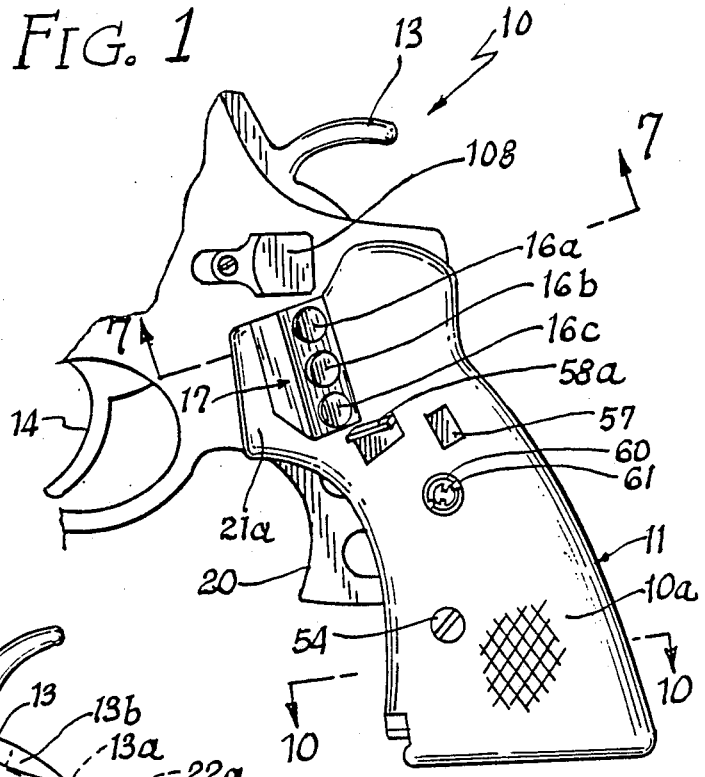
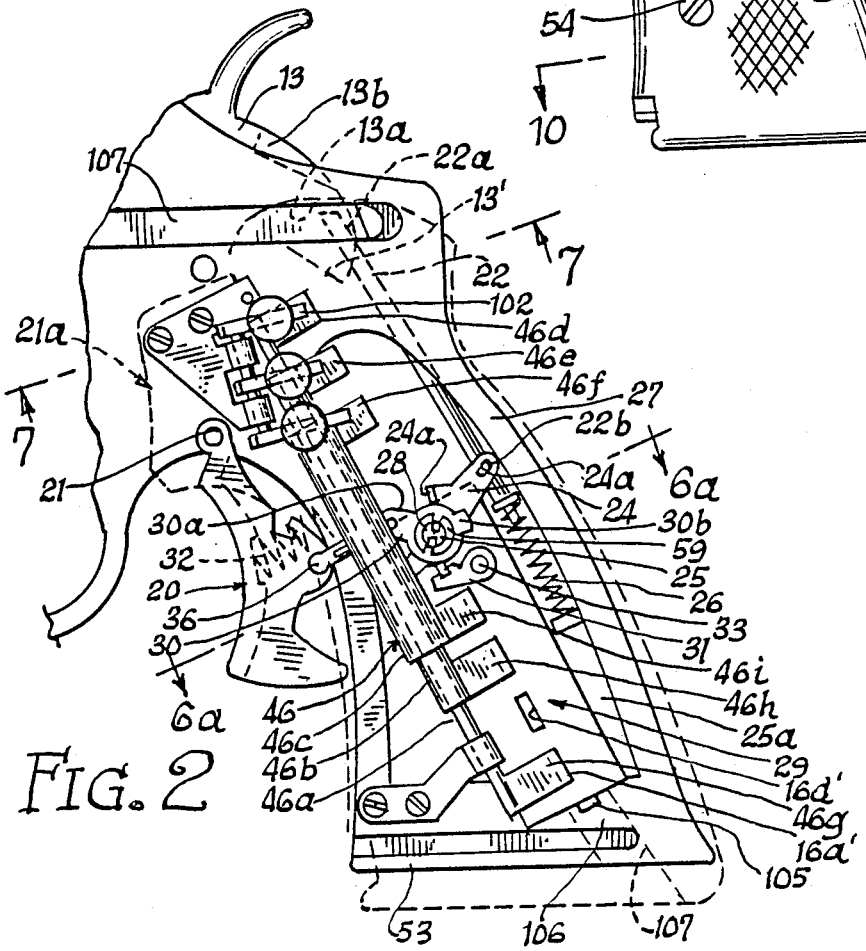
FIG. 2

FIG. 10
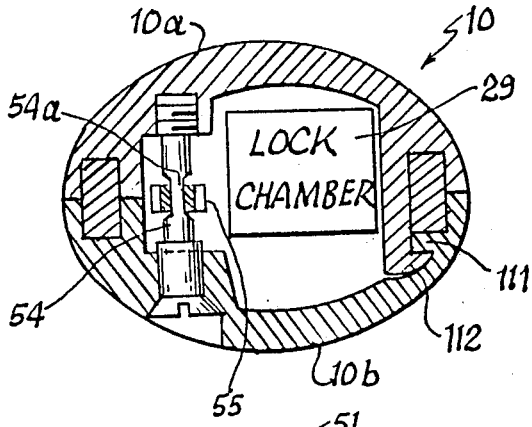
FIG. 12
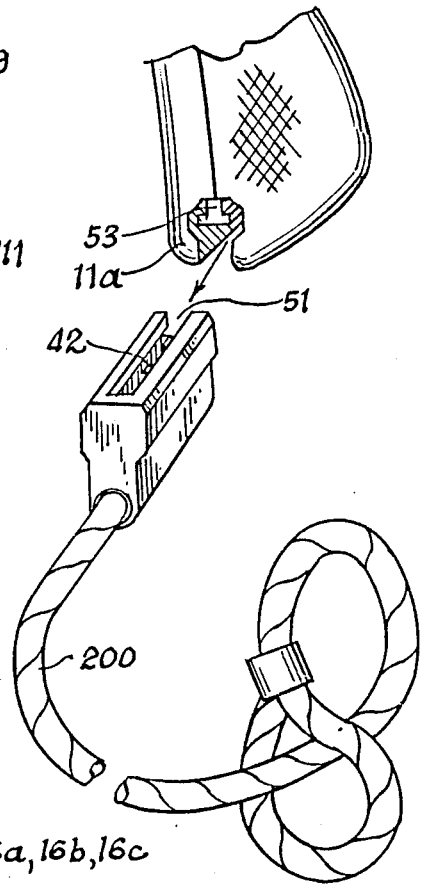
FIG. 11
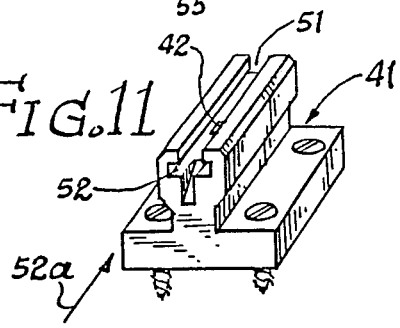
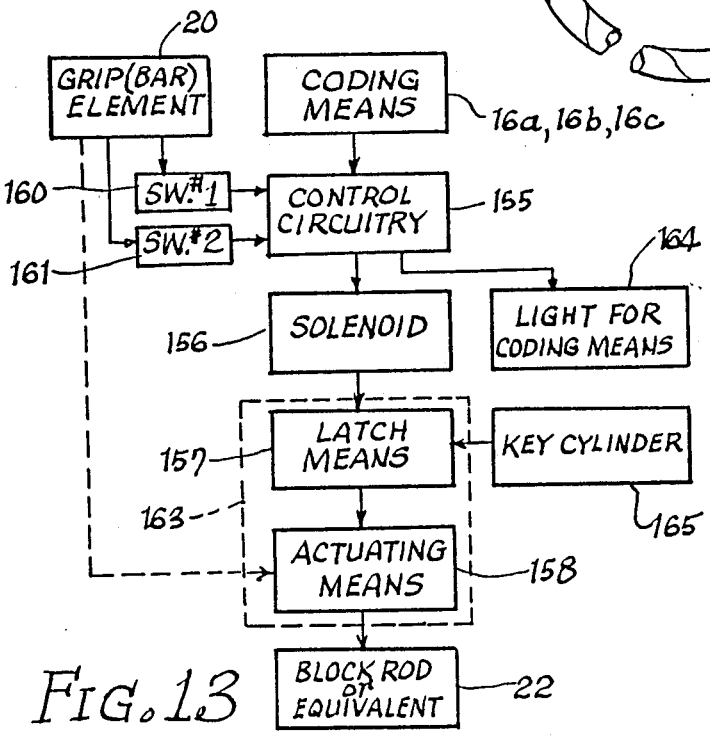
FIG. 13

HANDGUN LOCKING AND UNLOCKING APPARATUS

BACKGROUND OF THE INVENTION

This invention relates generally to locking devices for guns, and more particularly to devices to lock guns against inadvertent or unauthorized firing, but at the same time to enable quick and controlled unlocking of guns, to enable their use, as against home intruders.

Guns with combination coded locking devices are known, as disclosed for example in U.S. Pat. Nos. 2,803,910 to Lyle; 4,302,898 to La Rue; 3,735,519 to Fox; and 4,457,091 to Wallerstein. However, such devices are faulty and lack the unusual combinations of features, functions and results as are now afforded by the present invention; and which uniquely meet the needs of the user, as will appear.

SUMMARY OF THE INVENTION

It is a major object of the invention to provide solutions to the user's needs, as referred to. For example, it is a purpose of the invention to provide an improved gun for gun owner interest in self, home and family protection, and in various environments and circumstances. The invention has three other main objectives:

1. to prevent accidental or unauthorized firing but allow for quickest and easiest access to a loaded gun;

2. to prevent a danger of the owner's gun being wrested away and used against him in the case of encountering assailants;

3. to provide security from gun being stolen and/or used if tampering is attempted. Thus, the improved gun of the invention serves society as well as its individual owner, as many stolen guns are later used in other crimes.

The improved gun preferably incorporates a push button combination lock, either being an electronic circuit in combination with electronic motor such as a solenoid, or a mechanical type lock, making it safe from un-authorized firing, yet will allow authorized use of the gun within two seconds or less after picking up the weapon. The said lock is interactive with a finger operated safety-grip-bar, which when pulled in, with the correct combination inserted, allows operation of the gun, and when released, disables the gun and clears the previous coded entry from the lock. Means for mounting and locking the gun to a mount surface or to a cable, and permitting for the quick release therefrom, is disclosed. Means for locking the handle covers to prevent tampering with locking devices is also disclosed. Mechanical and electronic lockout means to prevent repeated combination attempts are disclosed, means to lock bullets in gun is disclosed, as well as key override means to allow all functions of gun and invention without the combination being entered in the event of a forgotten combination or a battery failure as in an electronic embodiment.

The combination can be changed and made as simple or complex as required by the user. And, if the owner does not have to worry about children or others accessing the gun, or if he is concerned with unhampered access yet appreciates the other features, he has the option of "prearming" and storing or carrying the gun in a selectively and maintainably armed and ready condition by a catch means disclosed. Thus, the user still has a major benefit of the weapon being immediately locked and made unoperable upon gripping and releasing his grip from the weapon, so that if the weapon is taken from the user in the course of encountering assailants, or if there is a perceived danger of this happening, the weapon cannot be used against the user. The invention covers a mechanical lock version, which because of battery life may be more preferably than an electronic version.

The device with its grip bar, preferably located in the normal hand gripping area of the handle has distinct advantages over prior art in that the grip will disable the weapon directly in response to the grip bar being released, and the weapon cannot be re-enabled unless the correct combination is reinserted, because of the invention's unique feature of clearing past coded entries. Also, the grip bar performs mechanical aspects of unlocking and selectively maintaining an enabled state of action, thus saving electrical power; and the user may confidently know when the gun is armed or locked by feel; also, a non-power consuming mechanical catch may keep the grip bar in, and the gun armed in storage. The device also includes user changeable multicombination lock.

It is another object of the invention to provide coding means that includes multiple selectors such as at least two push buttons, and to locate the coding means for practical and advantageous ready use; and in this regard, the coding means is preferably located at the side of the gun proximate the upper extent of the handle, above the finger grip area thereof, within reach of the user's thumb, or opposite hand, and visible when the handle is gripped by the user's "gun" hand. Also because the safety-grip-bar is preferably located on the finger gripping area, the coding means is preferably spaced from same to provide advantageous cooperation without mutual interference.

Basically, the invention is embodied in a gun having a handle, barrel, and action including a hammer and trigger, and includes, in combination (a) first means for controlling the operation of said action, (b) and second means for controlling said first means and including independently functioning finger actuable members, at least two of said members defining a coding means, (c) said second means having, alternately, two states between which it is actuable, and characterized as (i) a first state in which the coding means is cleared (as will hereinafter be described) and said gun action is disabled, by first means, (ii) and a second state in which said members have been finger actuated in a sequence to cause said first means to enable said gun action, (d) said second means also having means to cause said first means to selectively maintain the gun action in an enabled state, (e) and, optionally, there being visual indicator means carried by the gun to be responsive to at least one of said first and second means to provide a visual indication of the enabled state of the gun action.

Also, a particular member may be operatively connected in disabling to enabling relation between the coding means and said action and movable between two positions is characterized as:

(i) an advanced position in which the coding means has been automatically cleared, and action is disabled, (ii) a retracted position in which said action is enabled.

And as referred to above, the particular member may take the form of a grip bar extendinng between the trigger and the handle, to be finger gripped. The bar is typically mounted to pivot between the advanced and retracted positions.

More specifically, interaction may be provided between the coding means and grip bar characterized in that the bar has a selected position in which it is blocked from movement to said retracted position until the coding means is placed in predetermined finger operated coded state. This provides further advantage over previous art in that the same grip element may be used to quickly clear incorrect coded entries, as opposed to a separate button, as grip bar moves from said selected to advanced position, in addition to its enabling function. Also, inadvertent button entries will be prevented unless the bar is at the gripped-selected position.

The referenced first means may include, specifically, a first blocking rod having an extended position in which it blocks hammer movement, and a retracted position in which it unblocks hammer movement, and actuating means operatively connecting the grip bar and said blocking rod to effect rod movement to retracted position in response to movement of the grip bar between such positions; and the actuating means may then include:

($x_1$) a rotary element operable to retract the blocking rod in response to element rotation, ($x_2$) said grip bar adapted to effect rotation of said rotary element in response to grip bar movement to said retracted position.

A blocking structure may be provided to be movable between blocking position in which grip bar and blocking rod movement to said retracted positions is blocked, and unblocking position in which grip bar and block rod movement to retracted positions is enabled, the blocking structure being responsive to said coding means.

In this regard, means may be employed and connected to the blocking structure and operable to displace said structure to unblocking position when said coding means is placed in predetermined finger operated state.

It is a further object of the invention to provide a means carried by the gun for locking the gun to a gun mount, and having a first position in which the gun is locked to the mount and the coding means is cleared, and a second position in which the gun is unlocked from the mount and the coding means has been finger actuated to enable the gun action; to this end, a second blocking rod may be operatively connected to the rotary element to be displaced, in response to said rotary element rotation, from a first position in which the second rod locks the gun to a gun mount, to a second position in which the second rod releases the gun from the mount.

It is yet another object of the invention to provide an auxiliary or backup lock mechanism responsive to insertion of a key to be rotatable, and a connection between said rotary lock mechanism and said blocking structure, to move same from blocking to unblocking positions, as aforesaid, in response to key insertion enabled rotation of the rotary lock mechanism.

A yet further object is to provide a catch mechanism as aforesaid, operable to retain the grip bar in its retracted position without hand-gripping, and the gun maintained in an enabled state, until the bar is again squeezed, thereby enabling return of the bar to said advanced position, and a spring urging the bar toward such advanced position.

Another advantage over previous art is a provided warning indicator, which, especially in combination with said means for maintaining action in an enabled state, makes it clear to user when gun is unlocked when he might assume otherwise. In this regard a warning flag may be mounted to said block rod, to be in alignment with an external window, when rod is in said retracted position.

These and other objects and advantages of the invention, as well as the details of an illustrative embodiment, will be more fully understood from the following specification and drawings, in which:

DRAWING DESCRIPTION

FIGS. 1–1A are side elevations showing a gun and gun handle;

FIGS. 2–5 are side elevations showing mechanism with the gun handle;

FIG. 10 is a section taken through the handle on lines 10—10 of FIG. 1 to show handle sections;

FIG. 11 is a perspective view showing a handle mount;

FIG. 12 is a perspective view showing a tether attached to the mount; and

FIG. 13 is a functional block diagram.

DETAILED DESCRIPTION

Figure 1A:
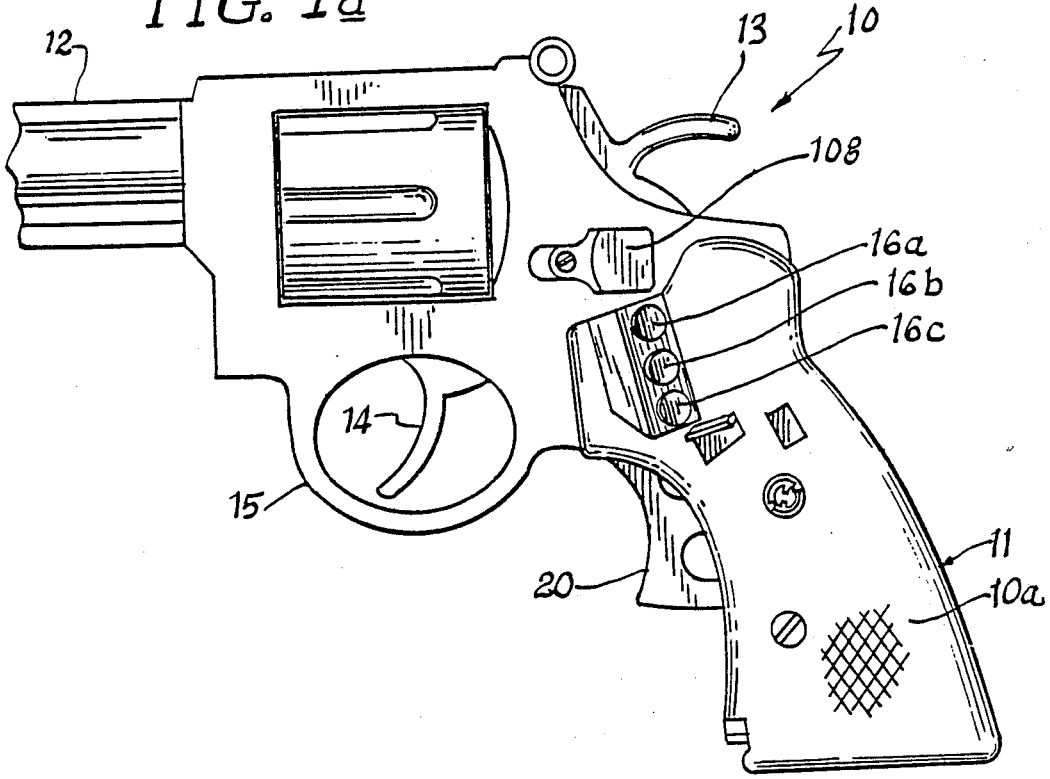

Referring first to FIGS. 1–5, the illustrated hand gun 10 includes a handle 11, barrel 12, and action, including a hammer 13 and trigger 14. A guard for the trigger appears at 15. These elements are shown as illustrative only, it being understood that there are many types of such elements employed on different types of guns, the invention being applicable to a wide variety of such guns. The handle 11 may typically includes a hollow housing defined by left and right side plates **10*a* and 10*b* retained in assembled condition by fastener 54 and a bottom section 10*c*. See also FIG. 10**.

In general, first means is provided for controlling the operation of the gun action, as for example blocking and unblocking movement of the hammer; and second means is provided controlling the first means. Such second means may be considered to include independently functioning finger actuable members, as for example the two selectors in the form of push buttons **16*a* and 16*b* (at least) shown at the upper left hand side of the handle, within easy reach of the user's thumb when the user grips the handle. Two or more of such members, such as buttons, may be employed, to define a decoding means. (See 16*a* to 16*c***).

The second means referred to is characterized as having, alternately, two states between which is actuable, including:

(i) a first state in which the coding means 17 has been automatically cleared and the gun action is disabled, by the first means, (ii) and, a second state in which the members (as at 16*a* and 16*b*) have been finger actuated in a sequence to cause the first means to enable the gun action.

Further, a particular member is typically operatively connected in disabling to enabling relation between the coding means and the gun action, and is movable between two positions characterized as (i) an advanced position in which the gun is disabled and the coding means has been automatically cleared, and (ii) a retracted position in which the gun action is enabled.

Such particular member takes the form, in FIGS. 1 and 2, of the safety grip bar 20 extending between the trigger 14 and the handle, to be finger gripped when the user grips the handle. As indicated, the grip bar is pivoted at 21 to gun structure 21*a* to pivot between the described advanced (forward, toward trigger) position shown in FIG. 1, retracted positions (see grip bar position in FIG. 5) indicating the rearwardmost position of the bar, and a selected or intermediate position (see FIG. 4), Means, as for example a compression spring 32 normally yieldably urges the grip bar to its advanced (solid line) position seen in FIGS. 1–3. When the bar is in selected, as for example intermediate position seen in FIG. 4, it is blocked from movement to retracted position (FIG. 5) until the coding means is placed in predetermined finger operated coded state.

Figure 3:
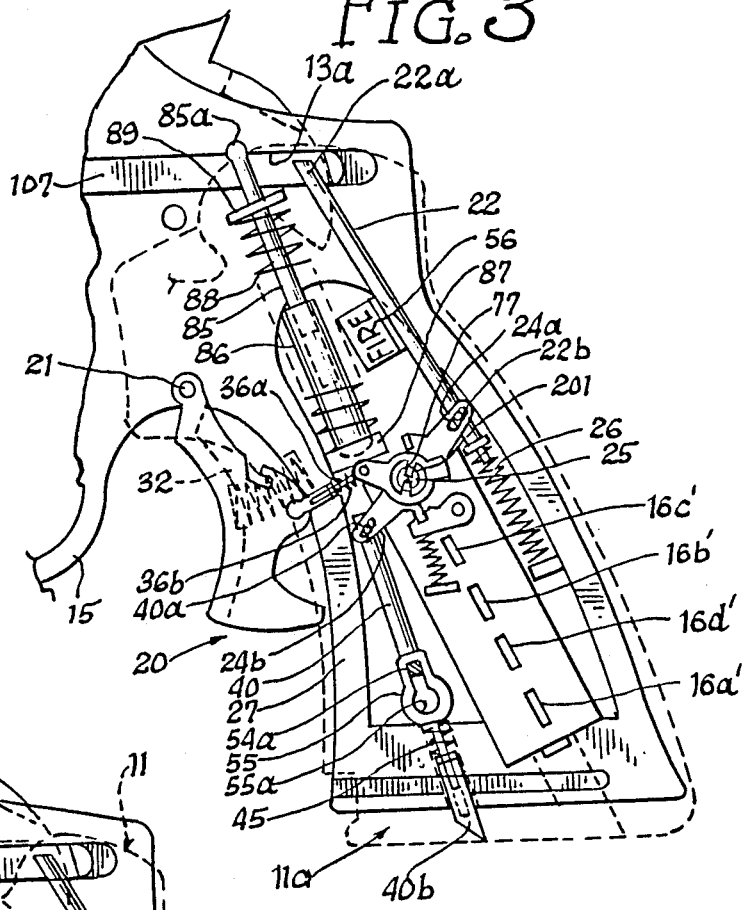

The referenced first means for controlling the operation of the gun action is shown in the example of FIGS. 2 and 3 to include a first blocking rod 22 having an upwardly extended position, as indicated, in which it blocks hammer rearward movement. Note the upper end 22*a* of the rod 22 blocking the lower edge 13*a* of the hammer, to block its downward pivoting. The rod also has a retracted, i.e. lowered, position in which it unblocks hammer movement, allowing downward and rearward swinging of the hammer to cocked position, as viewed in FIG. 5. See dotted line 13' in FIG. 5.

Figure 5:
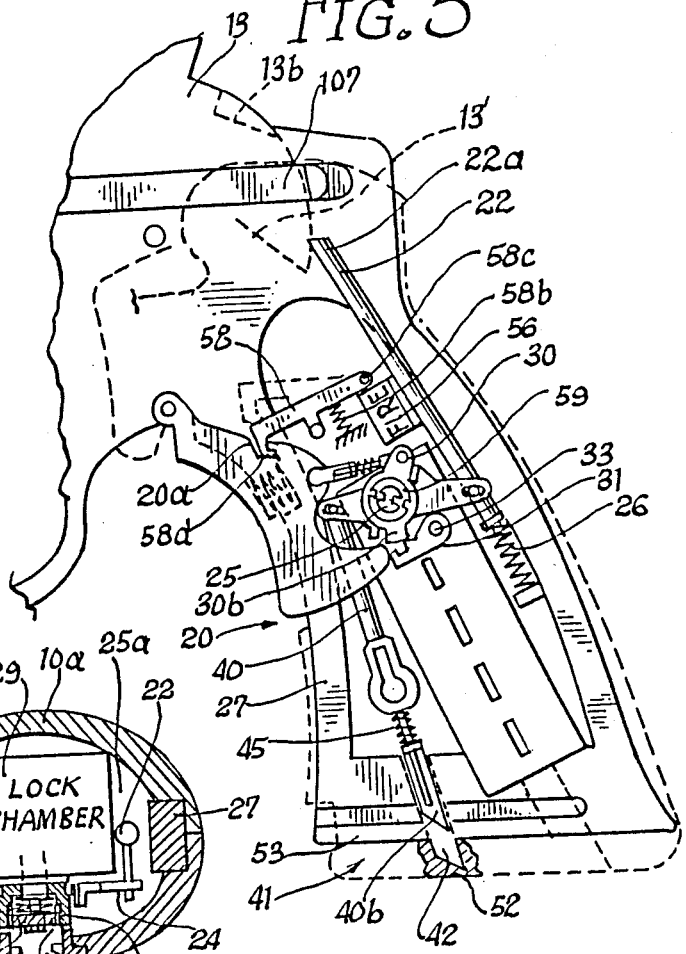

The referenced first means may also include, actuating means operatively connected between the grip bar and the blocking rod to effect rod movement to retracted position in response to movement of the bar to retracted position. In the example, such actuating means takes the form of a rotary element such as rotor or operating lever 24 rotating about a pivot axis 25 and operable to retract the blocking rod downwardly in response to rotor clockwise rotation. To this end, the rotor may have a slot 24*a* engaging pin 22*b* on the rod 22 within the handle cavity 25*a*, to drive the rod downwardly, compressing return spring 26. See FIG. 5 showing the spring 26 compressed. Frame 27 may provide a bore within which the rod is guided for its movement between advanced and retracted position.

Figure 4:
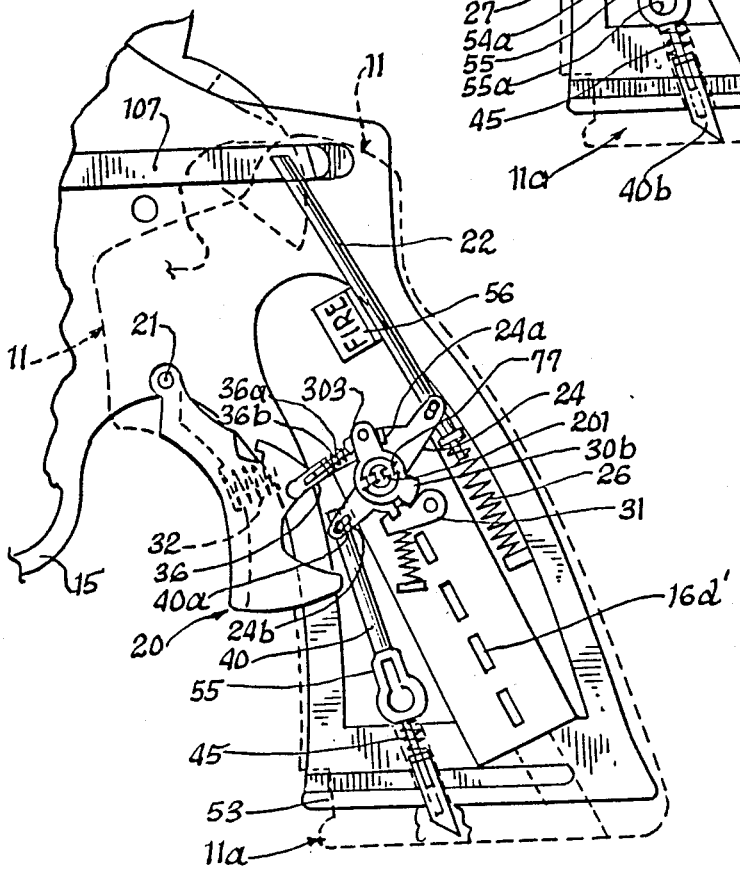

To control the actuating means as referred to, a blocking means or structure is provided to be movable between blocking position (as seen in FIGS. 2–4) in which grip bar and block rod movement to retracted position is blocked, and unblocking position (as seen in FIG. 5) in which grip bar and block rod movement to retracted (i.e. FIG. 5) positions is enabled. As seen in FIGS. 2–5 one form of blocking means includes: a rotary part such as actuating lever 30 rotatable about the axis 25 independently of rotation of rotor 24; a latch 31 blocking rotation of rotor 24 until rotation of lever 30 releases the latch from the rotor 24; and the lock axle 28. Thus, if one were to try to cock the hammer downward it would be blocked by latch 31 engagement with rotor 24. Rotation of the rotor is enabled by release (for rotation) of lock axle 28, by proper coding of lock 29. Axle 28 is connected to lever 30. Note pivoting of latch 31 to the lock at 33. Link 36 connects the grip bar to the lever 30 to rotate the latter clockwise; and a toe cam 30*b* on lever 30 engages and releases (pivots) the latch 31 (see FIG. 5) after proper coding of the lock by the push buttons releases axle 28 allowing rotation of lever 30.

An abutment 30*a* on lever 30 engages an abutment 24*a* on rotor 24, to rotate the latter and thus displace rod 22 downwardly, after lost motion rotation of lever 30.

As seen in FIGS. 3–5, a second blocking rod 40 is also operatively connected to the rotor 24 (as by slot 24*b* in the rotor and pin 40*a* on rod 40) to be displaced in response to rotation of rotor 24, from a first position (see FIG. 3) in which the second rod locks the gun to a gun mount, to a second position (see FIG. 5) in which the second rod is elevated and releases the gun from the mount. As shown in FIG. 11, the mount 41 mounting the lower end 11*a* of handle 11, (see FIG. 3) has a downward recess 42 (see FIG. 11) sized to closely receive the lower end 40*a* of rod 40, in locked position. The rod 40 extends upwardly in the handle and is loosely guided by frame 27 for upward movement, to release rod end 40*a* from the recess or notch 42. A spring 45 on the rod is compressed when the rod is in its downwardly locked position to allow mounting of the gun, as the handle is moved in direction of arrow 52*a* in FIG. 11, so that mounting and locking are achieved without pulling on the grip bar. As seen in FIG. 11, the gun mount may be secured by screws to any flat surface such as a desk wall or a counter. Because the gun may be locked over said screws, mount is secured as well. Alternatively, as shown in FIG. 12 the mount may have a cable tether 200 allowing attachment to other fixtures such as car seats or bed frames.

The axle 28 extending from the lock chamber 29 has three possible positions: In its first position seen in FIGS. 2 and 3 it will clear previous coding entries upon the axle moving from second position seen in FIG. 4. Also, no entries may be registered within the lock chamber mechanism in this first position until the axle is manually placed by the hand operated grip bar in second position. The latter is at 45° relative to first position. The axle is prevented from turning further clockwise (to third position of FIG. 5) until the proper coded sequence is entered by depression of the push buttons 16*a* to 16*c* on the lock while the axle is in second position.

A summary of operation is as follows:

1. In operation, a user picking up the weapon depresses grip bar 20 and pulls it back from outermost position FIGS. 1–3 to intermediate position of FIG. 4 and it thereby moves actuating lever and lock axle simultaneously to corresponding positions as in FIG. 4. Further movement of the actuating lever, which is engaged with the lock axle is blocked by the lock mechanism itself. Spring 36*a* and plunger 36*b* in the grip bar link 36 help to dampen the force on the actuating lever 30 (to relieve excessive force and friction which might hamper lock mechanism operation).

2. The lock axle is thus placed in position so that the lock can now take push button combination entries. Buttons 16*a*, 16*b* and 16*c* located in thumb area in the upper left extent of handle are connected to the lock chamber by means of a trundle 46 system (FIG. 2).

3. If code entered is incorrect, the user will discover same by trying to pull the back further, but it will not move. The user then releases the grip bar; and spring 32 in between the grip bar and frame of the gun, as well as the internal springing of the lock mechanism, will cause the axle and actuating lever and thus the grip bar to move back to first position (FIGS. 1–3). This will cause the incorrect entry to clear. When the grip is pulled back to intermediate or selected position (FIG. 4) the button entries may be retried.

4. Upon insertion of the correction combination, the lock axle 28 will be released and the user may now pull back the grip bar 20 to third position as shown in FIG. 5, and the actuating lever will rotate backwards and cause the rotation of the operating lever and retraction of block rod 22; but for this to happen, in tight succession, (moving from FIG. 4 to FIG. 5) as the actuating lever rotates backward, toe cam **30*b* at bottom of the actuating lever causes the cam latch 31 to be displaced and disengaged from the rotor 24, i.e. the operating lever; and the actuating lever will then abut and push the operating lever 24, and thus both the actuating lever and the operating lever will move together to third position seen in FIG. 5**.

5. As the operating lever is so moved, it moves the gun action block rod 22 downward, allowing the action to operate by trigger pulling and bullets to be loaded or unloaded by cylinder bolt 107 movement. The opposite end of the rotor or operating lever will move the blocking rod at gun mount. (FIGS. 11 and 12 show the mount in detail, with a dado groove 52 to receive a tongue 53 at the lower end of the handle). Both these rods are directly connected to the operating lever and are spring biased towards their locking positions. The rods will stay in retracted positions as long as the grip bar is held in FIG. 5 position.

6. A screw collar 55 for screw 54 is connected to the lower mount locking rod is also moved upwardly to free a polygonal section **54*a* (FIG. 10) of handle cover screw 54 to turn in enlarged area 55*a* (FIG. 3) allowing removal of screw and handle covers 10*a* and 10*b*. A warning flag 56 on block rod 22 moves dowwnard into registration with external warning window 57 (FIG. 1**) to warn the user that the gun is armed.

7. A grip bar catch 58 (shown internally in FIG. 5, and externally by its tab **58*a* FIG. 1) may be engaged while grip bar is held in third position. Catch 58 consists of a lever which can be pushed down by user's thumb at side of gun causing a hook structure 58*d* to engage with grip bar catch notch 20*a* and while the grip is slightly released and catch is held down. Catch lever 58 is spring urged at 58*b* towards its upper disengaged position so that when the grip bar is regripped and moves in (rightwardly) slightly, the catch automatically disengages with the grip bar, by upward movement. Note catch pivot 58*c***.

8. When the grip is released from its fully retracted position it returns to its initial advanced position (FIG. 3) by said spring means, and all block rods and levers return to their initial "locked" positions. As both the actuating lever and the lock axle return, they cause the lock to clear itself from previous coding entries, with the end result that the coding must be reinserted before the gun may be re-enabled again, the only exception being a key override.

Figure 6A:
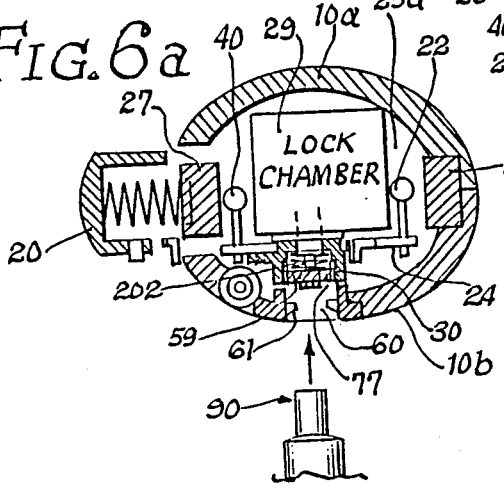
FIGS. 6A and 6B are sections taken on lines 6A—6A of FIG. 2.
Figure 6B:
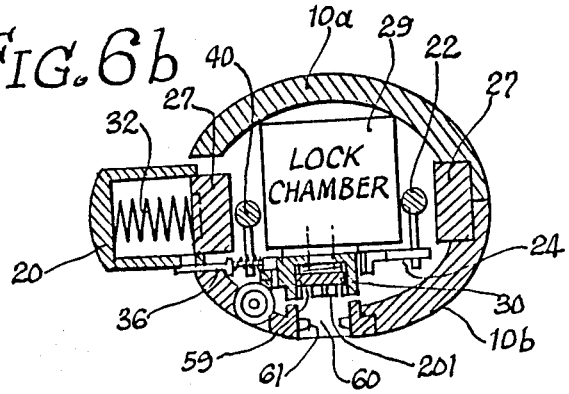

9. In this regard, lock axle 28 is positively engaged to actuating lever 30 by interlock gear 59, facilitated by various interlocking ridges and notches located (as shown) on the actuating lever 30 the interlock gear 59 and the lock axle 28. However, the lever 30 may be disengaged from the lock axle and turned by means of a key 90. This key may enter through an opening 60 in the handle wall **10*b*, and a lock bezel 61 (externally shown at FIG. 1, and internally at FIGS. 6A and B). The key being of round type, may embrace the lock axle. After the key passes through the bezel, it contacts the interlock gear and pushes it down, (FIG. 6*a*) along the axle, toward the lock. The interlock gear is normally biased towards its outer position by spring means 202 (FIG. 6A). When the interlock gear is displaced inwardly toward the lock, the interlock gear will stay engaged to the actuating lever but will disengage from the lock axle 28, as the axle grooves 201 (see FIGS. 3 and 6B) only extend on the outer portion of the axle. The actuating lever and gear 59** will then be free of the axle and may either be turned by the key or by the grip bar while the key is engaged. This will unlock the gun and its other functions as earlier described, i.e. allow trigger pull and operation of the gun action to fire the gun.

Because of an inner ridge 77 (FIGS. 6 and 3) in the actuating lever, the lever and the inner lock gear will move together and remain in alignment for re-engagement with the axle while depressed by the key, that ridge also facilitating key engagement with the actuating lever and turning of the actuating lever.

Figure 9A:
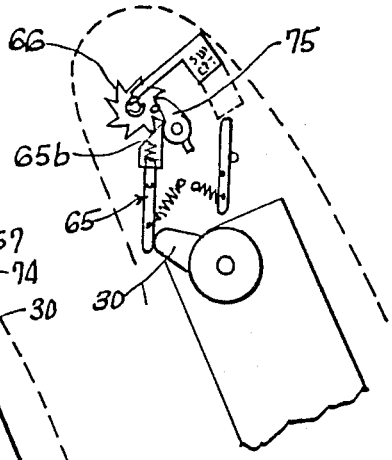
FIGS. 9A–9E are views showing different operating stages of lockout mechanism.

10. Lockout. A lockout device is incorporarated that will allow only a designated number of wrong attempts, as illustrated six times, to enter the correct combination before the device will lock the safety bar to its intermediate (FIG. 4) position, not allowing any further entires until a key can be inserted to unlock the lockout device allowing it to return to position 1 once again. This device will prevent thieves or other unauthorized persons from discovering the correct sequence to arm the gun. See FIGS. 9A and B.

Figure 9B:
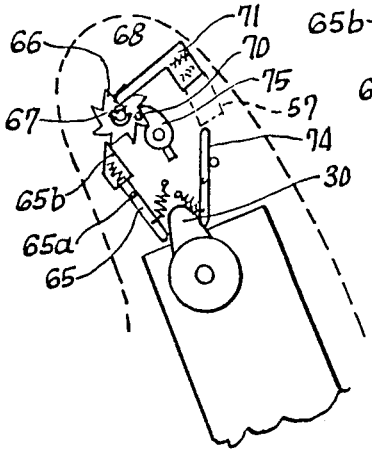
Figure 9C:
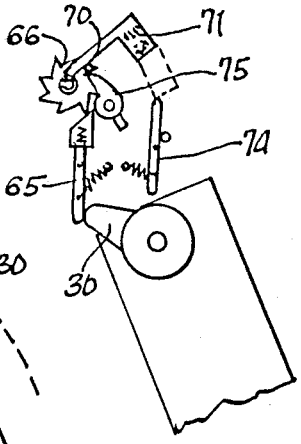

The mechanical lockout consists of a lockout arm 65 which is spring biased to lean on the forward part of the actuating lever. The lockout arm which is on a pivot is caused to be pumped by the actuating lever as it moves from position 1 to 2 and back to 1 again. When the grip bar is normally released from position 2 to position 1 its spring and the spring in the lock axle causes the actuating lever to move back to position 1 with enough force to move the lockout arm and ratchet forward the lockout wheel. When the grip bar is initially pulled in, the lock out star wheel 66 does not turn (FIGS. 9A to 9B) because the lockout arm 65 has a yieldable (spring plunger) tip **65*b* which allows it to retract and clear the wheel. But the lockout wheel is ratcheted forward on gear tooth upon the grip bar moving from FIG. 9B position to 9C position. Arm 65 pivots at 65*a***.

Figure 9D:
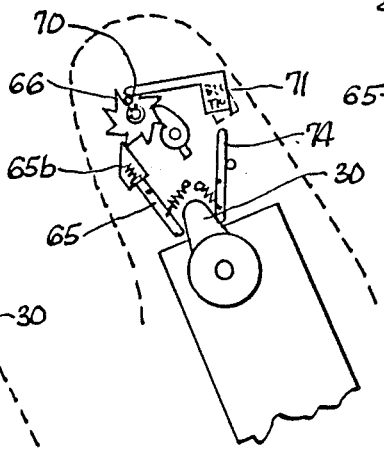
Figure 9E:
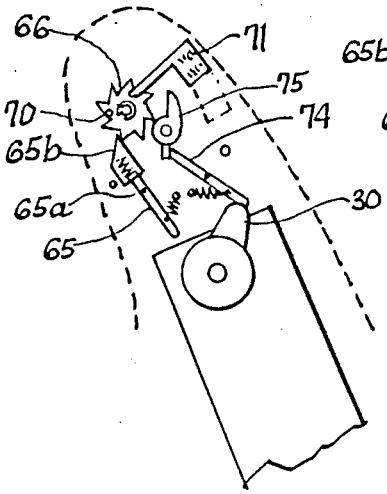

After a designated number of times—as shown, six times—of the actuating arm returning from intermediate position to initial (FIGS. 2–3) without reaching FIG. 5 position, the lockout wheel 66 which has reached full rotation will prevent the return of the lock arm, and thus block the actuating lever and grip bar from moving from FIG. 4 position back to position in FIG. 3 on the sixth pull of the grip bar (FIG. 9D). The lockout wheel will not continue rotating due to a notch 67 on its axle and a second lockout wheel notch 68 (labeled in FIG. 9). Upon reaching a lockout, flag finger 70 on lockout wheel 66 pushes lockout flag 71 into registration with a warning window 57, to warn user of a lockout.

In normal operation, FIG. 5 position would be reached in the first attempts before a lockout occurs. When the actuating lever moves from FIG. 4 to FIG. 5 position it will catch a reset lever 74 and disengage the pawl 75 from the lockout wheel, causing it to return to its primary position. See FIG. 9E.

11. Key override of lockout. If a lockout occurs, it may be disengaged by key 90 overriding the lock; as the actuating arm moves to FIG. 5 position it will operate the reset arm 74 and the pawl 75, and reset the lockout wheel as described above. See also FIG. 9E.

Figure 7:
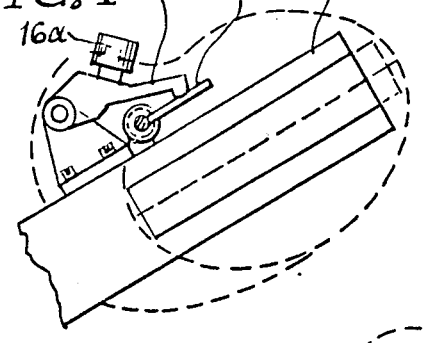
FIG. 7 is an enlarged section of lines 7—7 of FIG. 1.
Figure 8:
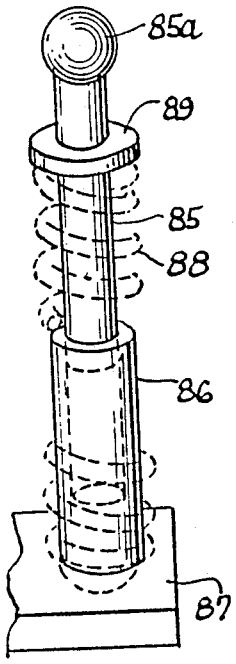
FIG. 8 is a perspective view showing a main spring and plunger.

Referring to FIGS. 3 and 8, the hammer actuating spring mechanism includes telescoping members 85 and 86, the top 85*a* of member 85 engaging the hammer. Upon retraction of the hammer, member 85 is received downwardly in member 86, so as ont to interfere with mechanism below the support 89 for the main spring 88 that engages a flange 89 on the member 85. It should be noted from FIGS. 1 and 7, the location and angulation of buttons 16*a–c* for advantageous and ready use by the user's gun-hand thumb or the opposite hand, while the user is holding the gun. Such a position also provides good visibility.

Referring to FIGS. 2 and 7, to connect the external buttons 16*a*–16*c* to the button tabs 16*a*'–16*c*' on the internal lock, a simple trundle system is provided involving telescoping tubes 46*a*–46*c* of varying diameters, the smaller tubes contained within the larger and all extending from the upper buttons to the lock in the lower portion of the handle. Alternately, separate small parallel rods may be used for each button.

At the tops of the tubes are paddles 46*d*–46*f*, and paddles 46*g–i* are provided at the lower rods of the tubes. Thus, as seen, when a button as at 16*a* is depressed, a paddle 46*d* is depressed by rocker arm 102, and paddle 46*g* is also depressed to push in a lock button tab 16*a*'. As seen, the lock has a vacant button tab 16*d*'.

The handle of the gun may be fitted with a locking mechanism 29 identical or similar to that manufactured by Simplex Lock Company described in U.S. Pat. No. 3,115,765, by Fengler, but may vary in number of buttons. The external turning "axle" and mounted levers are facing the left hand side of the gun and lock. FIGS. 3, 4 and 5.

The length and width of the lock chamber preferably are as small as will permit—about two inch length; and the springing of the lock axle is sprung internally to the extreme counter-clockwise position looking at the left side of the gun (FIG. 3); thus the lock is in its "clear" position naturally. Its axle has three positions as mentioned; furthest counterclockwise, position 1, it will clear previous button entries, or prevent entries from being registered; at position 2, 45 degrees clockwise it allows the lock to take button entries, but the shaft is locked from turning further clockwise to position 3 until the correct button combination is entered.

The gun may alternatively (and preferably) be fitted with a custom made lock, much like that of the inner workings of a pushbutton door lock assembly as described in U.S. Pat. No. 4,027,528 to McGourty or his earlier patents, the advantage and difference being that McGourty type lock has more combinations per buttons, because each button can be pushed a plurality of times whereas in the Simplex a single button may only be depressed once. (Note provision of a combination re-set button on the lock, at 105. It may be pushed to enable re-set of the combination, by inserting a tool in a bore 107 in the buttom of the gun).

As described in the sequencing section, there are two levers mounted on the lock axle: The actuating lever and the operating lever. The actuating lever is usually engaged with the axle by means of an interlock gear, which is a donut-shaped ring that interlocks between the axle shaft and the actuating lever. The actuating lever (and grip bar) moves with the lock axle in its three positions. The operating lever, or rotor 24 as described is normally blocked by the latch 31, but when this latch is disengaged by the toe cam 30*a* on the actuating lever, the actuating lever and rotor may move together toward position 3.

The key override may alternatively be in a key cylinder form and be located near the butt of the gun, where more space is provided, and may function by a relay, or rod to cause disengagement of the actuating lever from the axle, or to release the operating lever latch 31, and manually pull the operating lever downward.

The handle covers are typically molded of hardened plastic or rubber, or of graphite, and backed on its internal sides with plates or ribbing of metal, or entirely of metal, and then coated with a shock absorbant material. The interiors of the two handle covers are interlocking on the rear side as seen in FIG. 10, and secured by cover screw 54. See interlock projection 111 and 112 in FIG. 10. Because cover screw 54 is prevented from turning by screw collar 55 while block rod 40 is in lowered and locked position, handle covers will effectively secure lock mechanisms from tampering, as in the case of a stolen gun.

It should be noted that there are many methods of controlling or blocking the action of a gun, as evidenced by previous art. However, a preferred method, as disclosed, accomplishes the following: immobilizing the action to prevent even the cocking of the hammer and action; to allow disablement of the action when the action and hammer are cocked; and a means to lock the ammunition in the gun.

In this regard, it will be noted in FIG. 5 that when block rod 22 is retracted, it allows the cylinder bolt 107 to move forward by means of cylinder release button 108, seen in FIG. 1; whereas,, in its upper position seen in FIGS. 2–4, the rod 22 blocks forward movement of bolt 107 (a dog-leg on the bolt is blocked from travel by the rod). Thus ammunition may not be loaded or unloaded while gun is in locked disabled condition.

A notch 13*b* in the hammer receive the block rod 22 to prevent release of the hammer, when the hammer is fully retracted (or cocked), in the event the grip bar is released when the hammer is in fully retracted position (cocked). See dotted lines 13' in FIG. 2.

An electronic locking version of the invention using the same type of grip bar function as described in the mechanical lock embodiment may work similarly, in that it may have the same structure consisting of a grip bar, block rods for blocking the action and cylinder latch, for effecting the lock-mounting of the gun to a mounting block, for moving an identical screw collar to effectively lock and unlock the handle cover-halves of the gun, and for moving a warning flag in and out of alignment with an external warning window. It also can utilize a catch as previously described.

The difference between the two versions primarily lies in the fact that, the "rotor" or operating lever and the actuating lever, as described in the mechanical embodiment are replaced with a single rotor, a "hub", represented by actuating means block 158 in FIG. 13. The hub may be rotated by a directly linked grip bar after the correct entry is entered, and move the upper and lower rods as discussed in the mechanical embodiment. However, the hub is controlled, that is, freed and released by a latch means 157 operatively connected to a solenoid 156 which in turn is operated by electronc circuitry 155 in combination with input from coding means 16*a,b* and *c* and a grip bar activated switches 160 and 161.

FIG. 13 further illustrates an electro-mechanical solenoid 156 operatively connected between the coding means 16*a*–16*c* and the blocking rod 22. Control circuitry 155 is connected between the coding means and the solenoid to operate the solenoid in response to selected "coded" input to the coding means (i.e. buttons 16*a*–16*c* are finger activated in predetermined sequence). The solenoid in turn operates a latch means 157 between a first position in which movement of the blocking rod to retracted position is blocked, and a second position in which movement of the blocking rod to retracted position is enabled. Thus when latch is in activated position the grip bar is allowed to be pulled in.

Grip bar 20 moves block rod 22 and maintains the enabled state of action, and in this regard, a switch 161 activated by the retracted position of grip bar 20 may be provided to cause circuitry 155 to cut power to solenoid 156, thus conserving electrical power.

Alternately, the solenoid (or a motor) 156 can directly move the block rod 22 (or other means to disable and enable action) independent of the grip bar (without external mechanical inertia). This function is illustrated by ommiting functional block 163.

In this regard, the "grip" member as referred to may comprise a "kill switch" to be finger actuated when the user's hand grips the handle of the gun; and the kill switch may comprise a button associated with the coding means, i.e. the kil switch may be one of the selectors of the coding means. In this regard, finger operation of the kill switch in combination with correctly entered code typically enables the first "means" movement to retracted position, enabling the gun action, and release of the kill switch disables the action of the gun.

Circuitry 155 may include sensing circuit elements to sense various selected inputs from buttons 16*a*–16*c* and switches 160 and 161, digital circuitry to provide an output only when a predetermined input is sensed, amplifier means to amplify that output, and a driver to provide solenoid drive current in response to reception of that amplified output.

The circuitry 155 is preferably a single chip micro processor in combination with prewritten software, thus making the circuit an intelligent controller and very flexible for differing manufacturing and market needs. Such an embodiment also will reduce space and power requirements, and thus increase battery space and life, from previous art. Such a circuit may have random access (RAM) as well as read only (ROM) memories.

Thus the operation of the gun would then be controlled by the software preprogrammed into the circuit. Also the user can easily change the combination to his liking with existing external controls. Also, a layout feature can be provided with a time penalty to discourage or eliminate unauthorized enablement attempts. Electronic means for counting the number of incorrect entry attempts and assigning a "lock out" with time penalties preventing additional combination entry attempts is advantageous with such microprocessor and grip bar,as software may be written to accomodate this function more flexibly and efficiently than previous art. The circuit then counts the number of times switch 160 is activated before switch 161 is activated for this purpose.

Means for lighting coding buttons 164, preferably when the grip bar is at the selected positions, is afforded by a switch 160. This same switch will allow circuitry 155 to be in a very low or non-power consuming state to save battery power until switch 160 is activated by grip element movement to its selected position (as in FIG. 4) and in this regard the device should be installed with lithium battery cells, giving an approximate storage life of ten years. This version may readily utilize a key cylinder 165 for affecting enablement of gun functions without the combination being entered (as in previous embodiment) and is preferably operatively connected to latch means 157 to move it to said second position where movement of blocking to retracted position is enabled.

We claim:

1. In a gun having a handle, barrel, and action including a hammer and trigger, the combination comprising:

(a) a first means carried by the gun for selectively disabling or enabling said action, (b) second means carried by the gun for controlling said first means and including coding means having at least two members which are independently actuable by the gun user's finger or fingers, (c) said second means including an element operatively connected in disabling to enabling relation between said coding means and said gun action, and actuable between two states characterized as:

(i) a first state in which the coding means is cleared, and the gun action is normally disabled, and (ii) a second state in which the gun action is enabled after predetermined finger actuation of said coding means, (d) said second means also having means to cause said first means to selectively maintain the gun action in an enabled state, or selectively cancel said enabled state, (e) said element carried by the gun to be movable between a retracted position corresponding to said second state, and an advanced position corresponding to said first state, so that is is assured that the previous coding entries are cleared upon element reaching advanced position from the retracted position, (f) said element comprising a grip bar operatively coupled to said first means to maintain the first means in an enabled state in which said gun action is enabled by coding means having been correctly activated, (g) said handle having a surface to be finger gripped, and said grip bar is located at and proximate said surface to be gripped by the finger or fingers of the gun user for moving the grip bar to said retracted position, (h) said independently actuable members comprising push buttons located at the side of the gun generally above the level of finger or hand gripped extent of the handle, and within reach of the user's thumb.

2. The combination of claim 1 including indicator means carried by the gun to be responsive to at least one of said first and second means to provide a visual indication of the enabled state of gun action.

3. The combination of claim 1 wherein said element comprises a grip bar mechanically operatively coupled to said first means to maintain the first means in an enabled state in which said gun action is enabled by said coding means having been correctly activated.

4. The combination of claim 1 wherein said element bar is located between the handle and trigger.

5. The combination of claim 1 wherein there are at least two push buttons independent from said element.

6. The combination of claim 1 wherein said handle has a surface to be finger gripped by the user, and said coding means is spaced from said surface so as to be visible to the user as he grips the gun handle.

7. The combination of claim 1 including a selectively used mechanical catch carried by the gun in association with said first means to maintain said first means in an enabling position in which the gun action is enabled, after the coding means have been used to move the first means to said enabling position, so that the gun may be maintained in an enabled state without the user gripping the handle.

8. The combination of claim 7 including a catch release component carried by the gun for releasing the catch in response to user's finger displacement of said component, whereby the gun action is thereby disabled.

9. The combination of claim 8 including the catch release component located in the finger gripping area so as to disable the gun upon both gripping and releasing the handle of the gun in the normal finger gripping area.

10. The combination of claim 1 including a mainspring for operating said hammer with a supporting center plunger constructed in two-piece telescopic relation.

11. The combination of claim 1 including means for locking ammunition normally loaded into gun from being removed or loaded, said locking means for ammunition being responsive to operation of said coding means.

12. The combination of claim 1 including mechanical means for counting a number of incorrect coding attempts and clearing of the coding means, also having means for preventing the gun action from being enabled in response to said counting means counting a specified number of incorrect coding attempts and clearing of coding means.

13. The combination of claim 12 including a warning means associated with the gun handle to indicate a lockout state of the action.

14. The combination of claim 1 wherein said second means also has a secondary key operated means for enabling said action.

15. The combination of claim 1 wherein the handle includes handle covers which are locked and unlocked to a gun frame, so as to prevent unauthorized entry to the handle interior and in response to said coding means.

16. The combination of claim 14 characterized in that the key operated means has means to clear and reset an engaged lockout means.

17. The combination of claim 14 wherein the key operated means has means to clear a lockout imposed by an electronic circuit, by a switch means.

18. The combination of claim 1 including means for disabling the gun action while the hammer is in a cocked position.

19. The combination of claim 1 including means for maintaining the gun action in an enabled state without consuming electrical power.

20. In a gun having handle, barrel and action including a hammer and trigger, the combination comprising:

(a) first means carried by the gun for selectively disabling or enabling said action, (b) second means carried by the gun for controlling said first means and including coding means having at least two members which are independently actuable by the gun user's finger or fingers, (c) said second means including a grip bar operatively connected in disabling to enabling relation between said coding means and said gun action, and actuable between two states characterized as:

(i) a first position in which the coding has been automatically cleared, and the gun action is normally disabled, and (ii) a second position in which the gun action is enabled after predetermined finger actuation of said coding means, (d) said second means including a multicombination mechanical lock means associated with said coding means, said lock means also having a clearing or scrambling means being operatively connected to said grip bar.

21. The combination of claim 20 including means including a catch mechanism operable to retain the grip bar in said retracted position until the bar is squeezed, thereby enabling return of the bar to said advanced position, and a spring urging the bar toward said advanced position.

22. The combination of claim 20 including means for counting a number of incorrect coding attempts and clearing of the coding means, also having means for preventing the gun action from being enabled in response to said counting means counting a specified number of incorrect coding attempts and clearing of coding means.

23. The combination of claim 22 including resettable electronic lockout means associated with said grip bar.

24. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) a particular member being operatively connected in disabling to enabling relation between the coding means and said action and movable between two positions characterized as:

(i) an advanced position in which the coding means is cleared, and the action is disabled, and (ii) a retracted position in which said action is enabled, (f) said particular member is a safety grip bar located in the said surface, to be finger gripped, (g) said safety grip bar spaced from the coding means and extending between the trigger and the handle, to be manually gripped by the gun user, (h) said coding means members comprising push buttons, (i) and means normally urging the grip bar to said advanced position, the bar also having a selected position in which it is blocked from movement to said retracted position until the coding means is placed in predetermined finger operated coded state, (j) said selected and retracted positions being successively closer to the handle, than said advanced position.

25. The combination of claim 24 including means mounting the bar to pivot between said positions.

26. The combination of claim 24 wherein said coding means is located at a side of the gun proximate the upper extent of the handle.

27. The combination of claim 24 wherein said coding means is located at the side of the gun proximate the upper extent of the handle, within reach of the user's thumb when the handle is gripped by the user's hand.

28. The combination of claim 27 wherein said coding means comprises at least two push buttons.

29. The combination of claim 24 wherein said first means includes a first blocking rod having an extended position in which it blocks hammer movement, and a retracted position in which it unblocks hammer movement, and actuating means operatively connecting said particular member and said blocking rod to move the rod between advanced and retracted positions in response to movement of said particular member between said positions, said particular member comprising a grip bar.

30. The combination of claim 24 including indicator means to indicate when said first means is enabling the action.

31. The combination of claim 30 wherein the indicator means comprises a non-power consuming device.

32. The combination of claim 24 including means including a catch mechanism operable to retain the grip bar in said retracted position until the bar is squeezed, thereby enabling return of the bar to said advanced position, and a spring urging the bar toward said advanced position.

33. The combination of claim 24 including finger operable catch means having a primary position wherein the grip bar is freely movable from retracted to advanced position, and a secondary position wherein grip bar movement to its said advanced position is blocked, whereby the gun may be stored in armed condition.

34. The combination of claim 24 wherein said second means also has a secondary key operated means for enabling said action.

35. The combination of claim 34 characterized in that the key operated means has means to clear and reset an engaged lockout means.

36. The combination of claim 34 wherein the key has means to clear a lockout imposed by an electronic circuit, by a switch means.

37. The combination of claim 24 wherein the handle includes handle covers which are locked and unlocked to a gun frame, so as to prevent unauthorized entry to the handle interior and in response to said coding means.

38. The combination of claim 24 including a warning indicator means to warn the user, on the external surface of the gun, for the duration that the action is in an enabled state after said coding means have been operated in coding sequence.

39. The combination of claim 24 including means for disabling the gun action while the hammer is in a cocked position.

40. The combination of claim 24 including means for maintaining the gun action in an enabled state without consuming electrical power.

41. The combination of claim 24 including means for counting a number of incorrect coding attempts and clearing of the coding means, also having means for preventing the gun action from being enabled in response to said counting means counting a specified number of incorrect coding attempts and clearing of coding means.

42. The combination of claim 41 including resettable electronic lockout means associated with said circuitry and said grip bar.

43. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) a particular member being operatively connected in disabling to enabling relation between the coding means and said action and movable between two positions characterized as:

(i) an advanced position in which the coding means is cleared, and the action is disabled, and (ii) a retracted position in which said action is enabled, (f) said first means including a first blocking rod having an extended position in which it blocks hammer movement, and a retracted position in which it unblocks hammer movement, and actuating means operatively connecting said particular member and said blocking rod to move the rod between advanced and retracted positions in response to movement of said particular member between said positions, said particular member comprising a grip bar, (g) said actuating means including:

($x_1$) a rotary element operable to retract the blocking rod in response to element rotation, ($x_2$) said particular member adapted to effect rotation of said rotary element in response to member movement to said retracted position; and there also being blocking structure movable between blocking position in which said block rod movement to said retracted position is blocked, and unblocking position in which block rod movement to retracted position is enabled, said blocking structure being responsive to said coding means.

44. The combination of claim 43 wherein said blocking structure includes a latch responsive to said coding means.

45. The combination of claim 44 including an auxiliary rotary lock mechanism responsive to insertion of a key to be rotatable, and a connection between said rotary lock mechanism and said latch to release the latch, as aforesaid, in response to key insertion enabled rotation of the rotary mechanism.

46. The combination of claim 45 wherein said action include a first blocking rod having an extended position in which it blocks hammer movement, and a retracted position in which it unblocks hammer movement, and actuating means operatively connected with said blocking rod and said coding means to enable rod movement to retracted position, in response to actuation of said means, there being a spring normally urging the blocking rod toward extended position.

47. The combination of claim 43 wherein said actuating means is located within a housing defined by the gun handle.

48. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) a particular member being operatively connected in disabling to enabling relation between the coding means and said action and movable between two positions characterized as:

(i) an advanced position in which the coding means is cleared, and the action is disabled, and (ii) a retracted position in which said action is enabled, (f) said first means including a first blocking rod having an extended position in which it blocks hammer movement, and a retracted position in which it unblocks hammer movement, and actuating means operatively connecting said particular member and said blocking rod to move the rod between advanced and retracted positions in response to movement of said particular member between said positions, said particular member comprising a grip bar, (g) said actuating means including ($x_1$) a rotary element operable to retract the blocking rod in response to element rotation, ($x_2$) said particular member adapted to effect rotation of said rotary element in response to member movement to said retracted position, and there also being blocking structure movable between blocking position in which member movement to said retracted position is blocked, and unblocking position in which member movement to retracted position is enabled, said blocking structure being responsive to said coding means.

49. The combination of claim 48 wherein said actuating means includes a cam on said blocking structure and operable to displace a latch on said structure to unblocking position when said coding means is placed in predetermined finger operated coded stated, the latch blocking rotation of said rotary element.

50. The combination of claim 48 including a blocking rod also operatively connected to said rotary element to be displaced, in response to said rotary element rotation, from a first position in which the second rod locks the gun to a gun mount, to a second position in which the second rod releases the gun from the mount.

51. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) a particular member being operatively connected in disabling to enabling relation between the coding means and said action and movable between two positions characterized as:

(i) an advanced position in which the coding means is cleared, and the action is disabled, and (ii) a retracted position in which said action is enabled, (f) there being lost motion connection between the first means and the particular member.

52. In a hand gun having a handle, barrel, and action including hammer and trigger, the said action having a disabled state in which the hammer and trigger are non-responsive to trigger pull and an enabled state in which the hammer is responsive to trigger pull, the combination comprising (a) finger operated coding means on the gun, and (b) an element operatively connected in disabling-to-enabling relation between said coding means and said action, and movable between a first position in which the coding means has been scrambled and the action is disabled, and a second position in which the action is enabled and in response to predetermined finger operated coding of said means, (c) said coding means including at least one selector located above the level of the finger grip area of the handle, (d) said action including a first blocking rod having an extended position in which it blocks hammer movement, and a retracted position in which it unblocks hammer movement, and actuating means operatively connected with said blocking rod and said coding means to enable rod movement to retracted position, in response to actuation of said means, there being a spring normally urging the blocking rod toward extended position.

53. The combination of claim 52 wherein said element comprises a safety grip bar associated with the handle.

54. The combination of claim 53 wherein said actuating mens comprises a rotary element operatively connected with the blocking rod, a rotary part carrying a cam, and a catch blocking rotation of said rotary element until said cam releases said catch in response to rotation of said rotary part enabled by said coding means, rotation of said part then acting to rotate the rotary element to retract the blocking rod.

55. The combination of claim 54 wherein said rotary part and rotary element have lost motion interrelation.

56. The combination of claim 54 including a blocking rod, also operatively connected with said rotary element to be displaced in response to rotation thereof, from a first position in which the rod locks the gun to a gun mount, to a second position in which the rod releases the gun from the mount.

57. The combination of claim 52 including warning means operatively connected with a blocking rod to warn that the action is enabled, in response to movement of said element to second position.

58. In a gun having a handle, barrel and action including hammer and trigger, the combination including (a) first means carried by the gun for selectively disabling or enabling said action, (b) second means carried by the gun for controlling said first means and including coding means having at least two members which are independently actuable by the gun user's finger or fingers, (c) said second means having, alternately, two states between which it is actuable, and characterized as (i) a first state in which the handle is released by the user so that the coding means is cleared, with said gun action then being disabled, by said first means, (ii) and a second state in which said members have been finger actuated in a sequence to cause said first means to enable gun action, (d) and including means for counting a number of incorrect coding attempts and clearing of the coding means, also having means for preventing the gun action from being enabled in response to said counting means counting a specified number of incorrect coding attempts and clearing of coding means, (e) and including action lockout means including a ratchet, associated with the handle.

59. The combination of claim 58 wherein a particular member is operatively connected in disabling to enabling relation between the coding means and said action and movable between two positions characterized as (i) an advanced position in which the coding means is cleared, and gun is disabled and, (ii) a retracted position in which said action is enabled.

60. In a gun having a handle, barrel and action including hammer and trigger, the combination including (a) first means carried by the gun for selectively disabling or enabling said action, (b) second means carried by the gun for controlling said first means and including coding means actuable by the gun user's finger or fingers, (c) said second means having, alternately, two states between which it is actuable, and characterized as (i) a first state in which the handle is released by the user so that the coding means is cleared, with said gun action then being disabled, by said first means, (ii) and a second state in which said members have been finger actuated in a sequence to cause said first means to enable gun action, (d) and including means carried by the gun for locking the gun to a gun mount, and having a first position in which the gun is locked to the mount and the coding means is cleared, and a second position in which the gun is unlocked from the mount and the coding means has been finger actuated to enable the gun action.

61. In a hand gun having handle, barrel, and action including hammer and trigger, the said action having a disabled state in which the hammer and trigger are non-responsive to trigger pull, and an enabled state in which the hammer is responsive to trigger pull, the combination comprising (a) finger operated coding means on the gun, and (b) a part operatively connected in disabling-to-enabling relation between said coding means and said action, and movable between a first position in which the coding means is scrambled and the action is disabled, and a second position in which the action is enabled and in response to predetermined finger operated coding of said coding means, (c) said coding means including multiple selectors characterized in that when said selectors are finger released, the coding is scrambled whereby said element is then placed in disabling relation to said action, (d) and including means, including electronic circuitry, for maintianing the gun action in enabled state, without electrical power usage.

62. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means is cleared and said gun action is disabled, by said first means, (ii) and a second state in which said members have been finger actuated in a sequence to cause said first means to enable said gun action, (d) there being means to place said coding means in cleared state in response to finger release of said members, (e) there being warning means associated with the gun handle to indicate a lockout state of the action, (f) and including action lockout mechanism associated with the handle.

63. In a gun having a handle, barrel and action including a hammer and trigger, the combination including:

(a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) and wherein a particular member is operatively connected in disabling to enabling relation between the coding means and said action and movable between two positions characterized as:

(i) an advanced position in which the coding means is cleared, and the action is disabled, and (ii) a retracted position in which said action is enabled, (f) said first means including a first blocking rod having an extended position in which it blocks hammer movement, and a retracted position in which it unblocks hammer movement, and actuating means operatively connecting said particular member and said blocking rod to effect rod movement between advanced and retracted positions in response to movement of said particular member between said positions, (g) and wherein said actuating means comprises a solenoid operatively connected to the blocking rod.

64. The combination of claim 63 including control circuitry operatively connected between the coding means and said solenoid for operating the solenoid in response to a selected finger input to the coding means.

65. The combination of claim 63 including electronic circuitry including a single chip microprocessor together with pre-written software.

66. In a gun having a handle, barrel and action including a hammer and trigger, the combination including (a) first means for controlling the operation of said action, (b) and second means for controlling said first means and including independently functioning finger actuable members, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, (e) a particular member being operatively connected in disabling to enabling relation between the coding means and said action and movable between two positions characterized as:

(i) an advanced position in which the coding means is cleared and the action is disabled, and (ii) a retracted position in which said action is enabled, (f) and means for locking ammunition normally loaded into gun from being removed or loaded, said locking means for ammunition being responsive to operation of said coding means causing said first means to enable said gun action.

67. The combination of claim 66 including a cylinder bolt, and said means for locking ammunition includes a blocking rod which in a retracted position allows the bolt to move forward, and which in an alternate position blocks forward movement of the bolt.

68. In a gun having a handle, barrel and action including a hammer and trigger, the combination including (a) first means for controlling the operation of said action, (b) and second means for controlling said first means and including independently functioning finger actuable members, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, (e) a particular member being operatively connected in disabling to enabling relation between the coding means and said action and movable between two positions characterized as:

(i) and advanced position in which the coding means is cleared, and the action is disabled, and (ii) a retracted position in which said action is enabled, (f) and mechanical means for counting a number of incorrect coding attempts and clearing of the coding means, and also having means for preventing the gun action from being enabled in response to said counting means counting a specified number of incorrect coding attempts and clearing of coding means.

69. The combination of claim 68 including a warning means associated with the gun handle to indicate a lockout state of the action.

70. In a gun having a handle, barrel and action including a hammer and trigger, the combination including:

(a) first means for controlling the operation of said action, (b) and second means for controlling said first means and including independently functioning finger actuable members, at least two of said members defining a coding means, (c) said second means having, alternatively two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) and wherein a particular member is operatively connected in disabling to enabling relation between the coding means and said action and movable between two positions characterized as:

(i) an advanced position in which the coding means is cleared, and the action is disabled, and (ii) a retracted position in which said action is enabled, (f) and including mechanical means for counting a number of incorrect coding attempts and clearing of the coding means, also having means for preventing the gun action from being enabled in response to said counting means counting a specified number of incorrect coding attempts and clearing of coding means, (g) and including a warning means associated with the gun handle to indicate a lockout state of the action, (h) and including lockout mechanism including a ratchet.

71. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from said surface and to be visible to the user as he grips the gun handle, (e) and including means for locking and unlocking of a surface of the gun to an external mount, said locking and unlocking being responsive to operation of said coding means.

72. In a gun having a handle, barrel and action including a hammer and trigger, the combination comprising:

(a) a first means carried by the gun for selectively disabling or enabling said action, (b) second means carried by the gun for controlling said first means and including coding means having at least two members which are independently actuable by the gun user's finger or fingers, (c) said second means including an element operatively connected in disabling to enabling relation between said coding means and said gun action, and actuable between two states characterized as:

(i) a first state in which the coding means is cleared, and the gun action is normally disabled, and (ii) a second state in which the gun action is enabled after predetermined finger actuation of said coding means, (d) said second means also having means to cause said first means to selectively maintain the gun action in an enabled state, (e) and including means for lighting an area of the gun external surface proximate the coding means and in response to element movement.

73. In a gun having a handle, barrel and action including a hammer and trigger, the combination including (a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause a first means to enable said gun action, (d) said handle having a surface to be finger gripped by the user, and said members being spaced from said surface and to be visible to the user as he grips the gun handle, (e) and including a key override operable to unlock locking covers associated with said handle.

74. In a gun having a handle, barrel and action including a hammer and trigger, the combination including:

(a) first means for controlling the operation of said action, (b) and second means for controlling said first means and including independently functioning finger actuable members, at lesat two of said members defining a coding means, (c) said second means having, alternately two states between which it is actuable, and characterized as:

(i) a first state in which the coding means has been cleared and said gun action is disabled, by said first means, (ii) and a second state in which said members have been finger actuated in a sequence to cause said first means to enable said gun action.

(d) said handle having a surface to be finger gripped by the user, and said members being spaced from said surface and to be visible to the user as he grips the gun handle, (e) and including means, including electronic circuitry, for maintaining the gun action in enabled state, without electric power usage.

75. The combination of claim 74 wherein said circuitry includes a switch associated with said element grip bar and characterized as effecting electric power delivery when activated by said grip bar.

76. The combination of claim 74 wherein said circuitry includes a micro processor and software.

77. The combination of claim 74 including a part associated with said circuitry to disable the gun action in response to motion of said particular member which comprises a kill switch.

78. The combination of claim 74 including indicator means on the gun to indicate when said first means is enabling the action.

79. The combination of claim 74 including a selectively used mechanical catch carried by the gun in association with said first means to maintain said first means in an enabling position in which the gun action is enabled, after the coding means have been used to move the first means to said enabling position, so that the gun may be maintained in an enabled state.

80. The combination of claim 79 including a catch release component carried by the gun for releasing the catch in response to user's finger displacement of said component, whereby the gun action is thereby disabled.

81. The combination of claim 80 wherein the catch release component is located in the finger gripping area so as to disable the gun upon both gripping and releasing the handle of the gun in the normal finger gripping area.

82. The combination of claim 74 including a grip bar operatively connected in disabling to enabling relation between the coding means and said action and movable between two positions characterized as:

(i) an advanced position in which the coding means is cleared, and the action is disabled, and (ii) a retracted position in which said action is enabled.

83. In a gun having a handle, barrel and action including a hammer and trigger, the combination including:

(a) first means for controlling the operation of said action, (b) and second means for controlling said first means and including independently functioning finger actuable members, at least two of said members defining a coding means, (c) said second means having, alternately, two states between which it is actuable, and characterized as:

(i) a first state in which the coding means has been cleared and said gun action is disabled, by said first means, (ii) and a second state in which said members have been finger actuated in a sequence to cause said first means to enable said gun action, (d) said handle having a surface to be finger gripped by the user, and said members being spaced from sa1id surface and to be visible to the user as he grips the gun handle, (e) and wherein a particular member is operatively connected in disabling to enabling relation between the coding means and said action and movable between two positions characterized as:

(i) an advanced position in which the coding means is cleared, and the action is disabled, and (ii) a retracted position in which said action is enabled, (f) and including means for counting a number of incorrect coding attempts and clearing of the coding means, also having means for preventing the gun action from being enabled in response to said counting means counting a specified number of incorrect coding attempts and clearing of coding means, (g) and including resettable electronic lockout means associated with said circuitry and said grip bar, (h) and including a key override and switch means associated with said lockout means to reset said lockout means.

84. In a gun having a handle, barrel, and action including a hammer and trigger, the combination comprising:

(a) a first means carried by the gun for selectively disabling or enabling said action, (b) second means carried by the gun for controlling said first means and including coding means actuable by the gun user's finger or fingers, (c) said second means including an element operatively connected in disabling to enabling relation between said coding means and said gun action, and actuable between two states characterized as:

(i) a first state in which the coding means is cleared, and the gun action is normally disabled, and (ii) a second state in which the gun action is enabled after predetermined finger actuation of said coding means, (d) said second means also having means to cause said first means to selectively maintain the gun action in an enabled state, (e) and including means for locking and unlocking of a surface of the gun to an external mount, said locking and unlocking being responsive to operation of the coding means.

85. The combination of claim 84 wherein said mount is in proximity of the butt of the handle, thereby to be connectible to a frame define by the gun handle.

86. In a gun having a handle, barrel, and action including a hammer and trigger, the combination comprising:

(a) a first means carried by the gun for selectively disabling or enabling said action, (b) second means carried by the gun for controlling said first means and including coding means actuable by the gun user's finger or fingers, (c) said second means including an element operatively connected in disabling to enabling relation between said coding means and said gun action, and actuable between two states characterized as:

(i) a first state in which the coding means is cleared, and the gun action is normally disabled, and (ii) a second state in which the gun action is enabled after predetermined finger actuation of said coding means, (d) said second means also having means to cause said first means to selectively maintain the gun action in an enabled state, (e) and including key means operable to unlock locking covers associated with said handle.

87. The combination of claim 86 wherein said means to unlock locking covers includes a rod means movable between a first position in which a cover securing fastener is prevented from rotating, and a second position in which the fastener is allowed to rotate to unlock the covers.

88. In a gun having a handle, barrel, and action including a hammer and trigger, the combination comprising:

(a) a first means carried by the gun for selectively disabling or enabling said action, (b) second means carried by the gun for controlling said first means and including coding means having at least two members which are independently actuable by the gun user's finger or fingers, (c) said second means including an element operatively connected in disabling to enabling relation between said coding means and said gun action, and actuable between two states characterized as:

(i) a first state in which the coding means is cleared, and the gun action is normally disabled, and (ii) a second state in which the gun action is enabled after predetermined finger actuation of said coding means, (d) said second means also having means to cause said first means to selectively maintain the gun action in an enabled state, (e) said element carried by the gun to be movable between a retracted position corresponding to said second state, and an advanced position corresponding to said first state, so that it is assured that the previous coding entries are cleared upon element reaching advanced position from the retracted position, (f) said element comprising a grip bar mechanically operatively coupled to said first means to maintain the first means in an enabled state in which said gun action is enabled by coding means having been correctly activated, (g) said handle having a surface to be finger gripped, and said grip bar is located at and proximate said surface to be gripped by the finger or fingers of the gun user for moving the grip bar to said retracted position, (h) said independently actuable members comprising push buttons located at the side of the gun generally above the level of finger or hand gripped extent of the handle, and within reach of the user's thumb, (i) and including catch mechanism operable to retain the grip bar in said retracted position until the bar is squeezed, thereby enabling return of the bar to said advanced position, and a spring urging the bar toward said advanced position.

89. In a gun having a handle, barrel and action including a hammer and trigger, the combination comprising:

(a) first means for controlling the operation of said action, (b) and second means for controlling said first means and including finger coding means, (c) said second means having, alternately two states between which it is actuable, and characterized as:

(i) a first state in which the coding means has been cleared and said gun action is disabled, by said first means, (ii) and a second state in which said coding means have been finger actuated to cause said first means to enable said gun action, (d) and including means, including electronic circuitry, for selectively maintaining the gun action in enabled state, without electric power usage.

90. The combination of claim 88 wherein said second means includes a grip bar operatively connected in disabling to enabling relation between the coding means and said action and movable between two positions characterized as:

(i) an advanced position in which the coding means is cleared, and the action is disabled, and (ii) a retracted position in which said action is enabled.

91. The combination of claim 89 including a selectively used mechanical catch carried by the gun in association with said first means to maintain said first means in an enabling position in which the gun action is enabled, after the coding means have been used to move the first means to said enabling position, so that the gun may be maintained in an enabled state without the user gripping the handle.

92. The combination of claim 91 including a catch release component carried by the gun for releasing the catch in response to user's finger displacement of said component, whereby the gun action is thereby disabled.

93. The combination of claim 92 wherein the catch release component is located in the finger gripping area so as to disable the gun upon both gripping and releasing the handle of the gun in the normal finger gripping area.

* * * * *